US008387324B2

(12) United States Patent
Holm et al.

(10) Patent No.: US 8,387,324 B2
(45) Date of Patent: Mar. 5, 2013

(54) SUBSTRUCTURE FOR ALIGNING A BUILDING COVER STRUCTURE AND AN ASSEMBLY BRACKET FOR USE IN SUCH SUBSTRUCTURE

(75) Inventors: David Overton Chabre Holm, Smørum (DK); Nikolaj Bjerngaard, København Ø (DK)

(73) Assignee: Rookwool International A/S, Hedehusene (DK)

( * ) Notice: Subject to any disclaimer, the term of this patent is extended or adjusted under 35 U.S.C. 154(b) by 61 days.

(21) Appl. No.: 12/596,608

(22) PCT Filed: Apr. 15, 2008

(86) PCT No.: PCT/EP2008/054547

§ 371 (c)(1),
(2), (4) Date: Jan. 20, 2010

(87) PCT Pub. No.: WO2008/128928

PCT Pub. Date: Oct. 30, 2008

(65) Prior Publication Data

US 2010/0115872 A1 May 13, 2010

(30) Foreign Application Priority Data

Apr. 20, 2007 (EP) ..... 07106597
Sep. 11, 2007 (EP) ..... 07116122

(51) Int. Cl.
*E04B 2/00* (2006.01)
*E04B 1/38* (2006.01)
*E04B 1/74* (2006.01)

(52) U.S. Cl. ..... 52/506.06; 52/404.2; 52/700

(58) Field of Classification Search ..... 52/404.2, 52/506.06, 700, 506.01, 506.05, 512, 698, 52/699, 404.1
See application file for complete search history.

(56) References Cited

U.S. PATENT DOCUMENTS 4,438,611 A * 3/1984 Bryant ..... 52/309.2
7,424,793 B1 * 9/2008 Shriver ..... 52/235
(Continued)

FOREIGN PATENT DOCUMENTS

AT 342832 B 4/1978
(Continued)

OTHER PUBLICATIONS

International Search Report for International Appl. No. PCT/EP2008/054547, European Patent Office, mailed Jul. 4, 2008, 3 pgs.

*Primary Examiner* — Mark Wendell
(74) *Attorney, Agent, or Firm* — Sterne, Kessler, Goldstein & Fox P.L.L.C.

(57) ABSTRACT

The present invention concerns a substructure for aligning a building cover structure for an insulated wall (1), wherein said wall (1) is provided with a layer of insulation material (2), which is mounted to the wall (1) by a plurality of elongated insulation mounting members (3) and cover support profiles (4), which are mounted on the mounting members (2), comprises adjustment means for adjusting the distance between the mounting members (3) and the cover support profiles (4), wherein said adjustment means comprises two or more assembly brackets (5) mounted on at least one side of the cover support profile (4), and wherein each assembly bracket (5) comprises a cover support profile receiving first end (5A) and a distal second end (5B) adapted for penetration into the insulation material (2) on one or both sides of the insulation mounting member (3) and that the bracket is provided with apertures (11, 12) between said first and second ends (5A, 5B) receiving associated fasteners for securing the assembly bracket (5) to the cover support profile (4) and the insulation mounting members (3). This allows for a large amount of adjustment of the distance between the insulation mounting members and the cover support profiles. The adjustment system of the substructure is suitable for relative large insulation material layers, such as fibrous insulation thickness of up to 400 mm or more and the substructure according to the invention does not provide any or only a few thermal bridges as no full penetration of the insulation is needed for providing the adjustment of the cover support profile.

28 Claims, 5 Drawing Sheets

U.S. PATENT DOCUMENTS

| | | | | |
|---|---|---|---|---|
| 7,765,753 | B1 * | 8/2010 | Shriver | 52/235 |
| 7,886,491 | B1 * | 2/2011 | Shriver | 52/235 |

FOREIGN PATENT DOCUMENTS

| | | | |
|---|---|---|---|
| DE | 2127777 | | 1/1973 |
| DE | 2222815 | A1 | 11/1973 |
| DE | 2551706 | A1 | 5/1977 |
| DE | 4212930 | C1 | 1/1993 |
| DE | 9218001 | U1 | 5/1993 |

* cited by examiner

SUBSTRUCTURE FOR ALIGNING A BUILDING COVER STRUCTURE AND AN ASSEMBLY BRACKET FOR USE IN SUCH SUBSTRUCTURE

The present invention relates to a substructure for aligning a building cover structure for an insulated wall, wherein said wall is provided with a layer of insulation material, which is mounted to the wall by a plurality of elongated insulation mounting members for receiving building cover means mountable to the mounting members via adjustment means for adjusting the distance between the mounting members and the building cover means. The invention also relates to an assembly bracket for use in such substructure.

From DE 42 12 930 a substructure of such kind is described where the insulation material is secured to the wall by a number of vertically disposed inner U-profiles and where the outer skin of the building is mounted onto an outer reversely oriented U-shaped profile so that the two profiles are joined together at their overlapping distal portions which are provided with an array of holes for receiving fastening screws. These distal portions of the U-profiles are generally perpendicular to the wall and the adjustment possibilities embedded in the positioning of the fastener holes may be utilised so that an unevenness of a wall may be corrected and the outer building cover thereby is aligned.

Another substructure with means for adjustment by using U-profiles is known from DE 2 222 815 where the innermost U-profile is provided with teeth having a length corresponding to at least the thickness of the insulation. The profile is mounted so that these teeth are pierced through the insulation to ensure a predetermined distance from the wall surface to the outer mounting surface of the profile. However, this creates a thermal bridge which reduces the effect of the insulation. Furthermore, this system is not suitable for relative thick insulations.

Yet another example of such adjustment systems is known from DE 2 127 777 where an intermediate part may be rotated and thereby create a correction of the building cover, i.e. an alignment of an irregular inner wall. However, this system is not suitable for use in relation to an insulated wall.

The drawbacks of these known substructures are that the distance of adjustment is limited and that the building cover substructures are limited with respect to how thick an insulation layer that can be fitted to the wall.

Accordingly, it is an object by the present invention to provide a substructure for aligning the building cover on an insulated wall structure which eliminates the drawbacks mentioned above and specifically allows for an improved length of adjustment.

These objects are achieved by a substructure of the initially mentioned kind, wherein said adjustment means comprises a plurality of assembly brackets, and each assembly bracket comprises a building cover receiving first end and a distal second end adapted for penetration into the insulation material and wherein the bracket is provided with apertures between said first and second ends for receiving associated fasteners for securing the assembly bracket to the building cover means and to the insulation mounting members.

According to a second aspect of the invention, there is provided an assembly bracket for adjustment of a substructure of an insulated wall comprising a layer of insulation material, which is mounted to the wall by a plurality of elongated insulation mounting members for receiving building cover means, which are mountable on the mounting members via said assembly bracket, wherein the assembly bracket comprises a building cover receiving first end and a distal second end adapted for penetration into the insulation material and wherein the bracket is provided with apertures between said first and second ends for receiving associated fasteners for securing the assembly bracket to the building cover means and to the insulation mounting members.

According to the invention, the assembly brackets are provided with one or more distal ends, preferably having a cutting edge, engaging the insulation material and thereby facilitating the penetration into the insulation. This allows for a large amount of adjustment, e.g. up to 100-150 mm, of the distance between the insulation mounting members and the cover support profiles. Moreover, the adjustment system of the substructure according to the invention is suitable for relative large insulation material layers, such as fibrous insulation thickness of up to 400 mm or more. Advantageously, the substructure according to the invention does not provide any or only a few thermal bridges as no full penetration of the insulation is needed for providing the adjustment of the building cover means.

Preferably, the building cover means comprises cover support profiles, which are mounted on the mounting members with the assembly brackets between the mounting members and the cover support profiles. Moreover, each of the assembly brackets comprises the building cover receiving first end, which may be adapted for receiving the building cover support profile, and the distal second end, which may be adapted for penetration into the insulation material on one or both sides of the insulation mounting member. Hereby, a substructure may be provided, which offers a firm mounting of a building cover and which is cost-effective both in manufacturing and installation on the building site.

In the preferred embodiment, the assembly bracket is made of a sheet material, preferably a metal sheet material and more preferably a steel sheet material. It is by the invention realised that as an alternative, the bracket could be made of plastic or the like.

In the substructure according to the preferred embodiment, the assembly brackets are mounted on each side of the cover support profile. Hereby, the support surfaces of the cover support profiles are kept in a predetermined position, most preferably parallel to the supporting wall.

In the preferred embodiment of the invention, the assembly bracket is provided with at least two generally horizontally oriented rows of mounting holes and/or at least one elongated holes. In particular, the assembly apertures may include a first row of discrete holes and at least one elongated hole substantially parallel to the first row of holes. Hereby, after the assembly bracket is mounted onto the cover support profile, a preliminary attachment of the assembly bracket to the insulation retaining profile may be carried out by a fastener, such as a screw or a rivet, in the elongated hole, which allows for adjusting the distance between the cover support profile and the insulation retaining profile to align the outer support surface of the cover support profile. The assembly brackets and thereby the support profile can slide in the elongated holes and the distal ends of the assembly brackets can penetrate more or less into the insulation material in order to find the correct position of the cover support profile, i.e. the desired distance. When the desired distance is found, the attachment fastener inserted through the elongated holes may be fastened and a fastener, such as a screw or a rivet, is inserted through at least one of the mounting holes.

Advantageously, the row of holes is provided above the at least one elongated hole on the assembly bracket(s) on a first side of the cover support profile and the at least one elongated hole is provided above row of holes on the other side of the cover support profile. Hereby, rotation of the support profile is prevented as the fasteners used for the attachment are not concentrically arranged. Accordingly, by an assembly bracket according to this embodiment of the invention, movements other than in the direction of the elongated holes are prevented during the fitting of the substructure.

In another embodiment, the assembly bracket is provided with three rows of mounting holes and the middle row is made up by one or more elongated holes.

In a preferred embodiment, the assembly brackets are U-shaped having a central portion accommodating the cover support profile at the first end and two profile portions having distal ends adapted for penetrating the insulation on each side of the mounting member when mounted thereon. In this embodiment, the assembly bracket is a mounting bracket encompassing the cover support profile and provides engagement flanges on each side of the profile.

In the preferred embodiment of the invention, the distal end of the assembly bracket is provided with a cutting edge. Although the assembly bracket is made of a thin sheet material, it may be advantageous to provide the assembly brackets with a cutting edge in order to facilitating penetration into the insulation material. The cutting edge could furthermore be serrated to further enhance the penetration ability of the distal ends of the brackets.

In the preferred embodiment, the insulation material mounted in the substructure is a mineral fibre insulation material, preferably with a density of 75-180 kg/m$^3$. The main fibre direction of the insulation material is preferably parallel with the length direction of the insulation mounting member. Thereby, the distal end of the bracket penetrates the insulation more easy than if the fibre direction is perpendicular to the length direction of the insulation mounting member. However, it is realised that the invention is also applicable if other insulation materials are used, e.g. foam.

Preferably, the substructure according to the invention is capable of carrying a building cover structure with an area weight up to 100 kg/m$^2$, preferably up to 90 kg/m$^2$. Hereby, also heavy façade claddings may be mounted onto the substructure according to the invention.

Preferably, the elongated insulation mounting members are steel profiles with a substantially vertical orientation, but other orientations may also be provided.

The cover support profiles may preferably be oriented substantially parallel with the mounting members, but could alternatively be oriented substantially perpendicular to the mounting members.

In the following, the invention is disclosed in more detail with reference to the drawings, in which.

Figure 4:
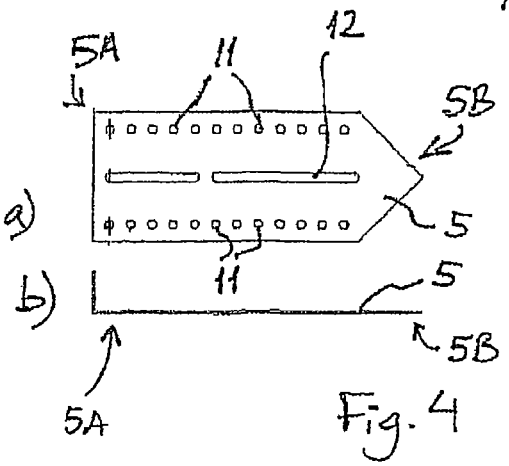
Figure 6:
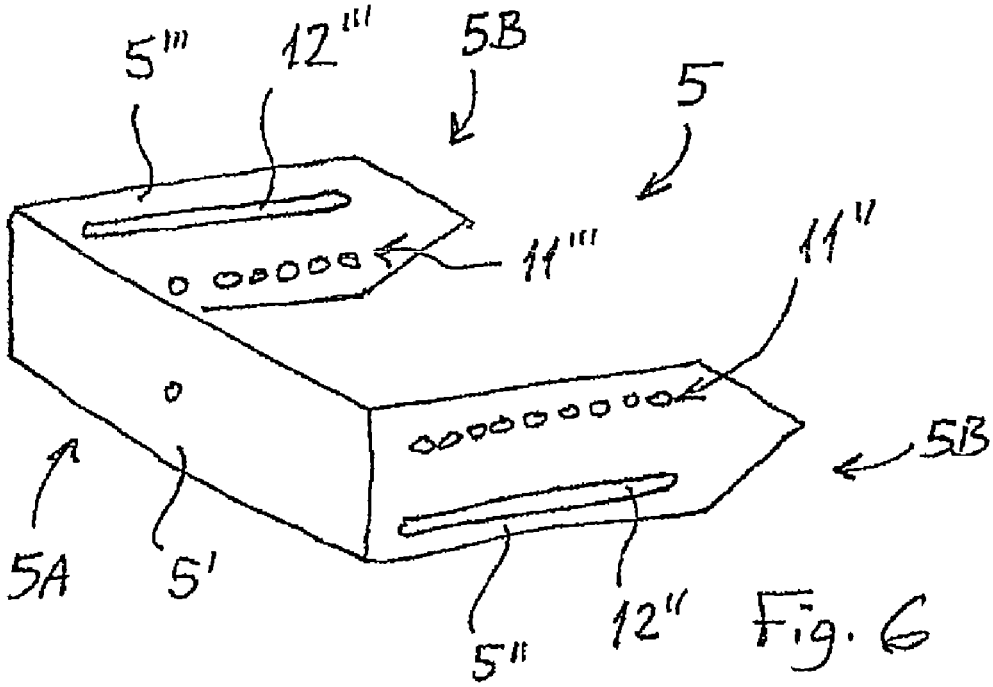
Figure 7:
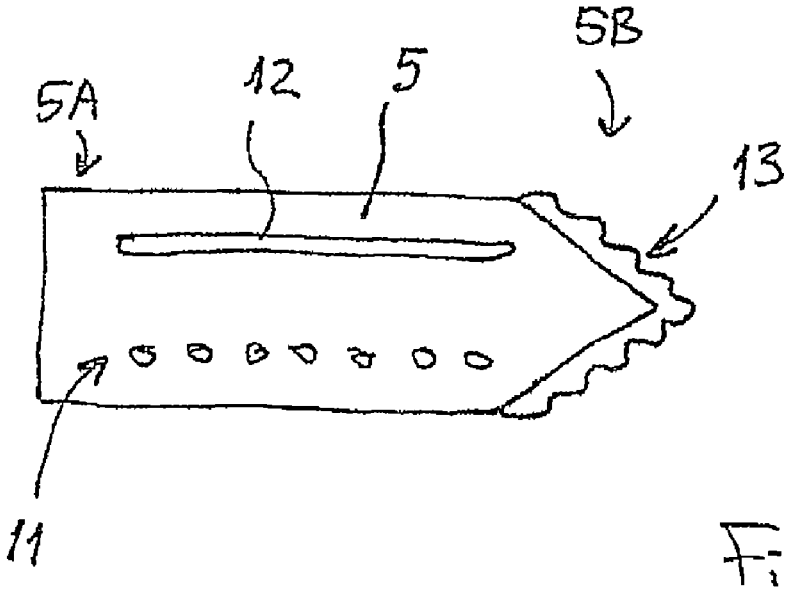
Figure 8:
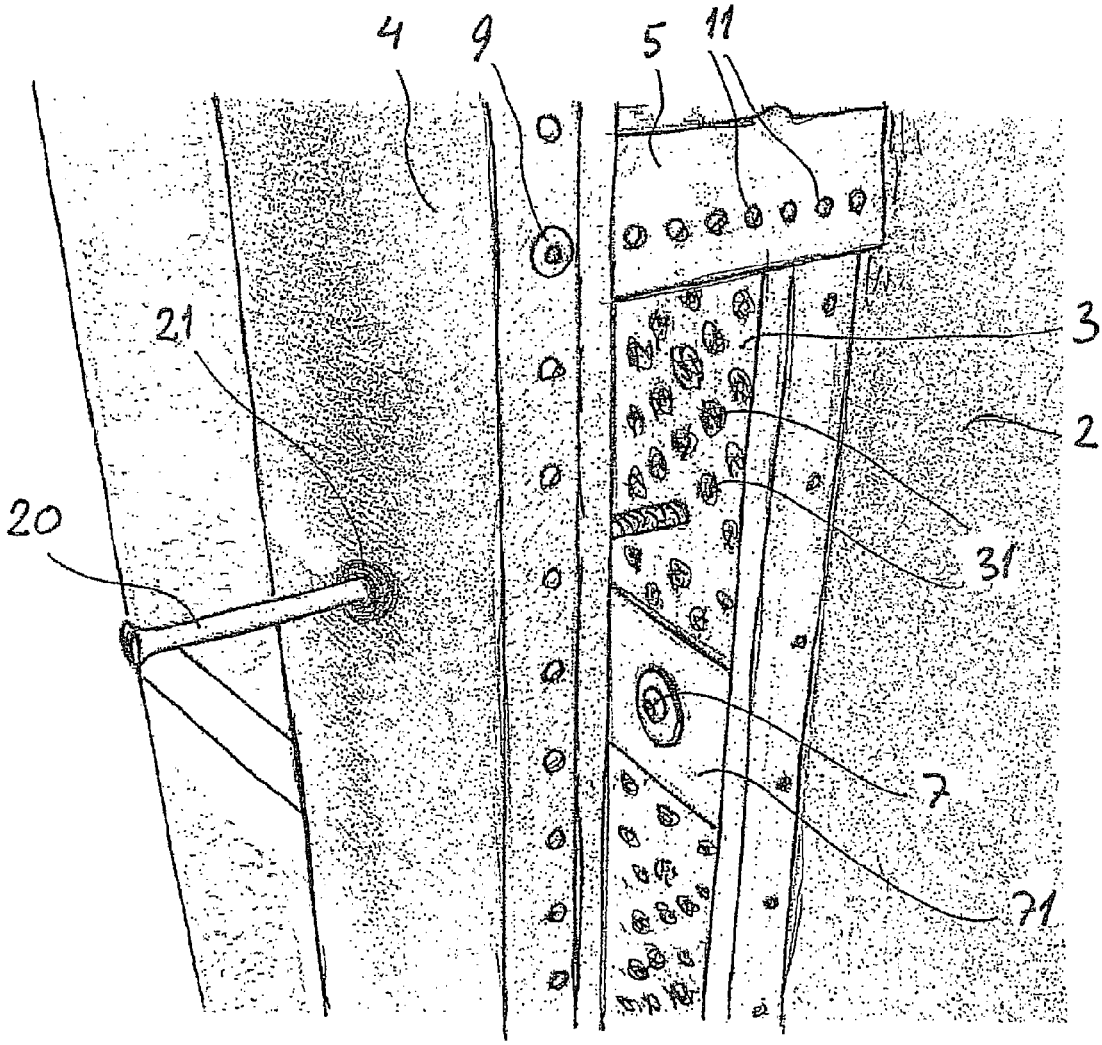
Figure 9:
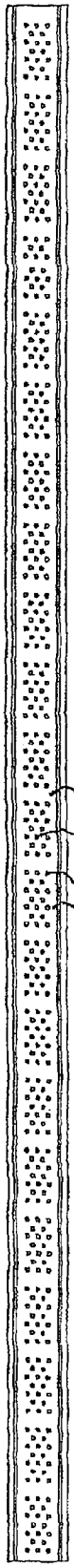
Figure 10:
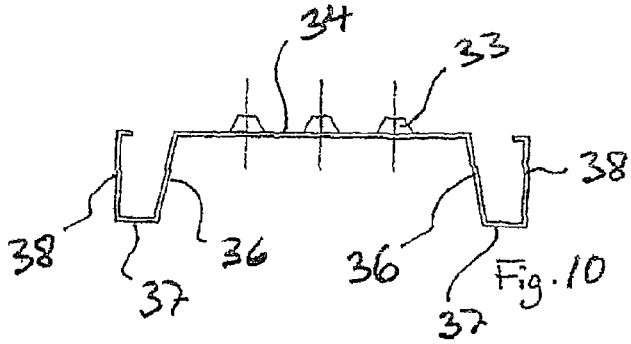
Figure 11:
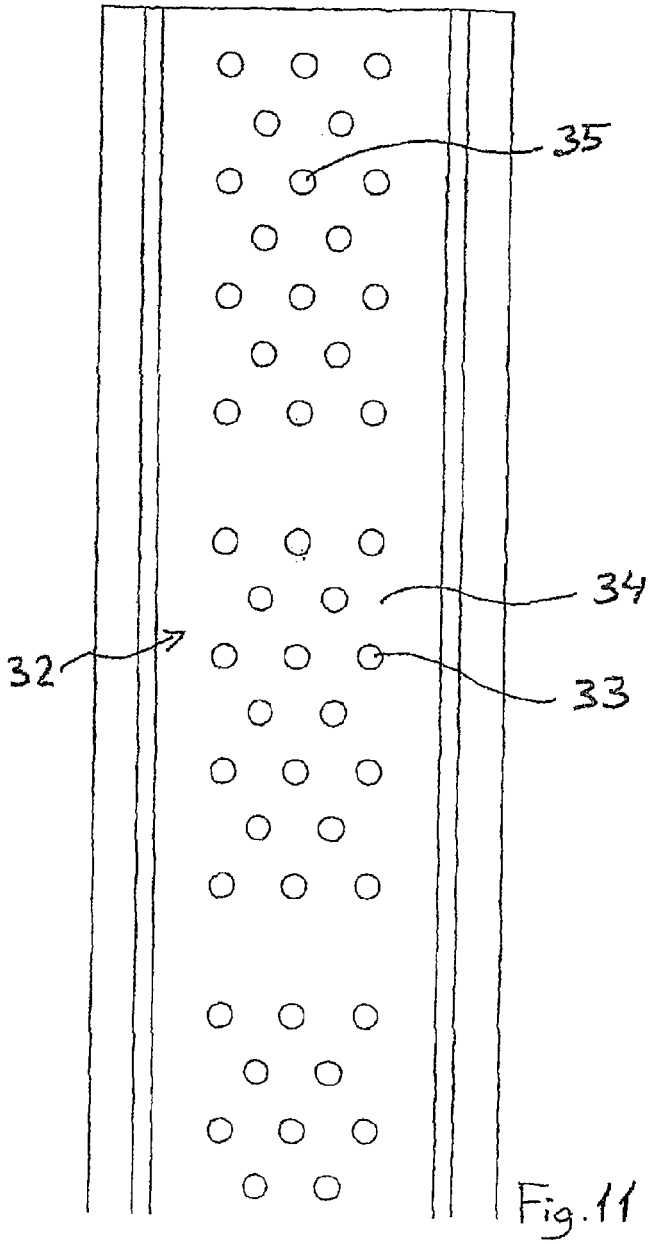

FIGS. 4*a*-4*b* are a side and top view respectively of an assembly bracket according to a first embodiment of the invention;

FIGS. 5*a*-5*b* are a side and top view respectively of an assembly bracket according to a second embodiment of the invention;

FIG. 6 is a schematic perspective view of a third preferred embodiment of an assembly bracket according to the invention, FIG. 7 is a side view of the assembly bracket in FIG. 6, FIG. 8 is a perspective detailed view of a further embodiment of the invention, FIG. 9 is a schematic top view of a mounting member profile according to an embodiment of the invention, FIG. 10 is a cross-section thereof, and FIG. 11 is a detailed view of the profile of FIG. 9.

Figure 1:
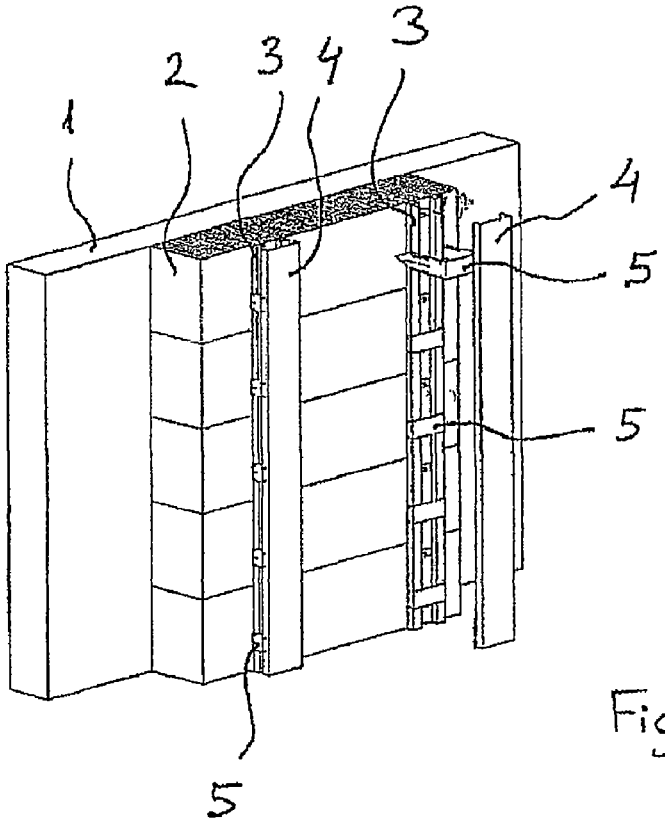
FIG. 1 is a schematic perspective view of a substructure according to an embodiment of the invention.
Figure 2:
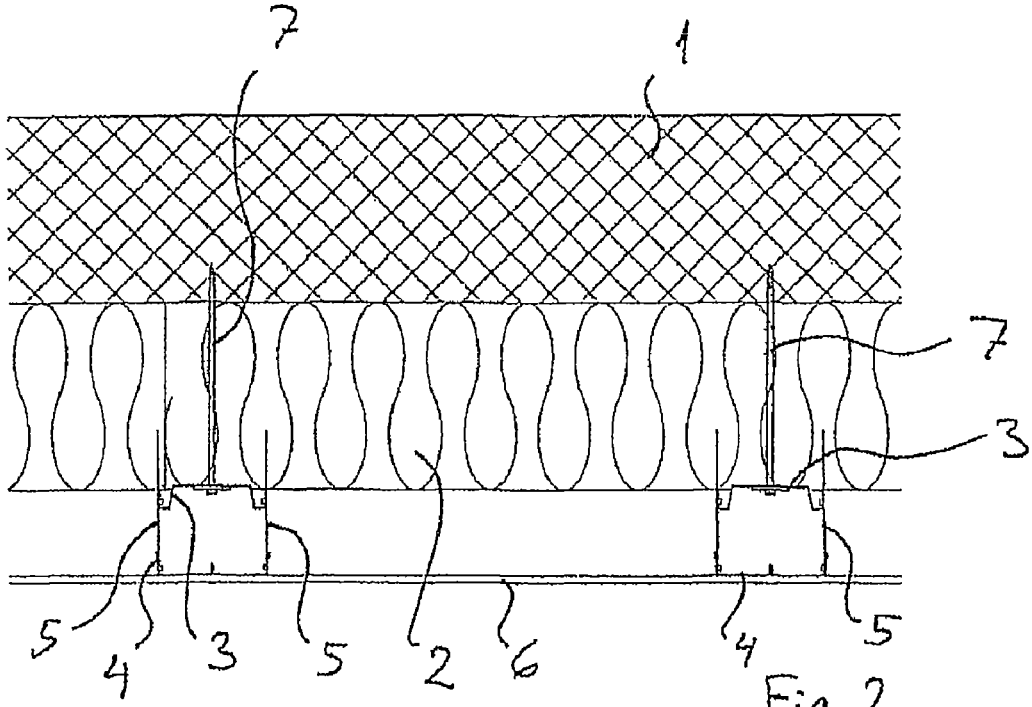
FIG. 2 is a schematic top view of a substructure according to the present invention.

In FIGS. 1 and 2, an embodiment of the substructure according to the invention is shown. The substructure comprises a wall 1 whereon slabs of fibrous insulation material 2 are mounted. The slabs of insulation material 2 are secured to the wall 1 by a number of mounting members 3, which are preferably insulation retaining profiles. Building cover support profiles 4 are mounted on the insulation mounting members 3 via a number of assembly brackets 5. A façade cladding 6 is mounted onto the cover support profiles 4, e.g. by a screw 10 or the like (see FIG. 3).

As an alternative to mounting the building cover façade cladding 6 onto the support profiles 4, it is realised that the building cover 6 may be mounted directly onto the assembly brackets 5, i.e. without the support profiles 4, whereby the building cover alignment may be carried out in points by individually adjusting the position of each of the assembly brackets 5 irrespective of neighbouring assembly brackets, e.g. mounted on the same profile.

Figure 3:
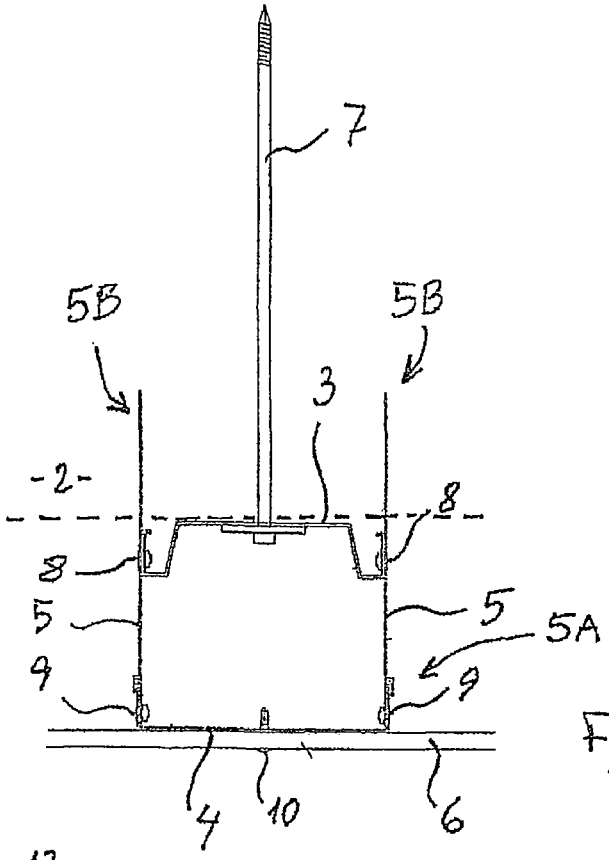
FIG. 3 is a detailed view of an assembly of profiles for a substructure according to the invention.

With reference to FIG. 3, the insulation mounting profiles 3 are secured to the supporting wall 1 by fasteners 7 which are pierced through the insulation layer 2 and into the supporting wall 1. The cover support profile 4 is provided with at least two brackets 5. The cover support profile 4 is secured to a bracket 5 on each side of the profile 4 by a fastener 9, such as a rivet, screw or the like at the cover support profile receiving first end 5A. The bracket 5 along the side of the mounting member 3 and the distal second end 5B of the bracket 5 extends into the insulation material 2. The brackets 5 are secured to the mounting profile 3 by fasteners 8, such as rivets, screws or the like.

The bracket 5 may be made of a bent metal sheet having two rows of attachment discrete holes 11 with a row of at least one, preferably two elongated holes 12 there between, as shown in FIGS. 4*a*) and 4*b*). Another embodiment of the bracket 5 is shown in FIGS. 5*a*) and 5*b*), where one row of discrete holes 11 and one row of at least one, preferably two elongated holes 12 are provided. In FIGS. 4*a*) and 5*a*) the two embodiments are viewed from the side and in FIGS. 4*b*) and 5*b*) they are viewed from above.

In FIG. 6 a third preferred embodiment of an assembly bracket 5 is shown. In this embodiment, two distal ends 5B are provided on flanges 5" and 5''' on each side of the cover profile which is accommodated in the profile receiving end 5A inside a flange 5'.

Figure 5:
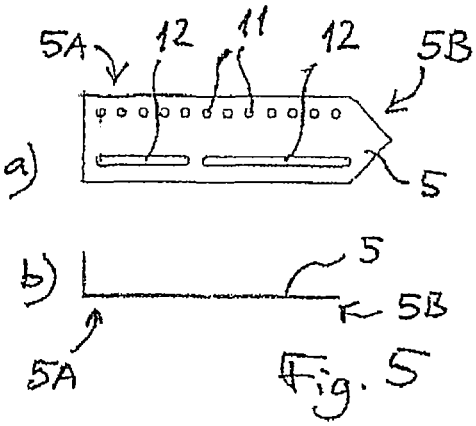

With reference to FIG. 5 and particularly FIG. 6, the row of discrete holes 11" is provided above the row of elongated holes 12" on the distal flange 5" of the assembly bracket 5 engaging the first side of the cover support profile 4 and the at least one elongated hole 12''' is provided above row of discrete holes 11''' on the other side of the cover support profile 4. Hereby, rotation of the assembly bracket 5 (and thereby the support profile 4) is prevented as the fasteners 8 inserted through the elongated holes 12", 12''' for the attachment are not concentrically arranged. Accordingly, by an assembly bracket 5 according to this embodiment of the invention, movements other than in the direction of the elongated holes 12 are prevented during the fitting of the substructure.

With reference to the figures, according to the preferred embodiment of the invention, the assembly brackets 5 are provided with a first row of discrete holes 11 and an elongated hole 12 substantially parallel to the first row of holes 11. Hereby, after the assembly bracket 5 is mounted onto the cover support profile 4, a preliminary or temporary attachment of the assembly bracket 5 to the insulation retaining profile 3 may be carried out by fasteners 8, such as a screw or a rivet, in the elongated hole 12, which allows for adjusting the distance between the cover support profile 4 and the insulation retaining profile 3 to align the outer support surface of the cover support profile 4 so that an even building cover 6 is ensured. The assembly brackets 5, and thereby the support profile 4, can via the fasteners 8 slide in the elongated holes 12 and the distal ends 5B of the assembly brackets 5 can be penetrated more or less into the insulation material 2 in order to find the correct position of the cover support profile 4, i.e. the desired distance. When the desired distance is found, the attachment fastener 8 inserted through the elongated holes 12 may be tightened or otherwise fully fastened and a second fastener 8, such as a screw or a rivet, is inserted through at least one of the discrete mounting holes 11. The receiving holes in the mounting member aligned with one of the discrete holes 11 are preferably drilled into the mounting member 3.

In order to ensure an easy penetration of the distal ends 5B of the assembly brackets 5 into the insulation 2, the distal ends 5B thereof are advantageously be provided with a cutting edge 13, particularly a serrated cutting edge 13, see FIG. 7.

By a substructure according to the invention, it is possible to align a building cover and thereby "absorb" irregularities of the installed wall of up to e.g. 100-150 mm. The insulation mounting profiles are preferably fastened to the wall by screws and plugs. The insulation may be retained in position against the wall by these mounting profiles. However, other suitable insulation mounting systems may also be used without departing from the scope of the present invention as defined in the claims. The building cover support profiles may be assembled to the insulation retaining profiles by assembly brackets e.g. for every 60 cm and the distance between the profiles is preferably between 40 and 200 cm depending on the weight of the façade cladding, i.e. the building cover structure. The substructure may be designed for specific façade cladding weight intervals, such as 0-25 kg/m$^2$, 25-50 kg/m$^2$ and 50-90 kg/m$^2$. The facade cladding may be fixed to the support profiles by rivets or screws.

By the substructure according to the invention, a ventilation slot is also provided in the wall structure. The ventilation slot may be 20-40 mm or more depending on the size of the assembly brackets and the roughness i.e. irregularities of the wall.

The substructure according to the invention provides an easy adjustment as the linear adjustment involves fewer lift operations than adjusting the surface as points, although even adjustment by points may be advantageous, since the allowable range of adjustment is significantly increased by the present invention. The substructure does not provide any or only a few thermal bridges as no full penetration of the insulation is needed for providing the adjustment of the cover support profile.

The profiles are bent into a desired shape ensuring a high bending resistance so that the substructure is rigid enough for handling on the construction site and easy to install.

With reference to FIG. 8, an adjustment screw 20 is provided through a hole 21 in the cover support profile 4 and which engages one of the friction enhancing embossed holes 31 in the mounting profile 3. The adjustment possibility thereby provided, enables the worker to turn the screw 20 e.g. by his mounting tool until the cover support profile 4 is in the correct position, e.g. where the support profile 4 is in alignment as the assembly brackets 5 are penetrated into the insulation layer 2. In practise, it is found advantageous to adjust the cover support profile 4 easily in a precise manner in this way rather than pressing the assembly brackets 5 inwards and into the insulation layer 2 by hand. According to this embodiment, an adjustment hole 21 is provided in the cover support profile 4 preferably in relation with each assembly bracket 5 and more preferably aligned with each assembly bracket 5, i.e. in the same position as the bracket 5, so that the screw 5 acts more directly on the distal ends 5*a*, 5*b* of the assembly brackets 5 where they are penetrated into the insulation 2. In the mounting profile 3, there is preferably already provided friction enhancing holes 31 by punching an array of holes therein so that a high friction between the mounting profiles 3 and the insulation is ensured. The hole 21 receiving the adjustment screw 20 may advantageously be provided with a bowl-like shape for accommodating the head of the adjustment screw 20.

If the support profile 4 is to be adjusted inwards, the screw 20 is tightened whereby the support profile 4 is being pulled towards the mounting members 3 and the insulation 2. Contrary, if the support profile 4 is to be adjusted outwards, the adjustment screw 20 is loosened whereby the profile 4 can be pulled outwards. In an embodiment, the adjustment screw 20 may be provided with retention means, such as barbs or a collar (not shown), underneath the screw head. When the screw 20 is mounted in the profile 4, this retention means engages the rear side of the profile 4 and the crew head engages the outer face of the profile 4. This ensures that the support profile 4 may be easily adjusted both inwards—i.e. towards the insulation and the building wall 1—and outwards by using the screw 20 so that manual outward adjustment of the profile may be avoided.

As an alternative to adjusting the cover support profile 4 directly be the adjustment screw 20, it is realised by the invention that the brackets 5 may be provided with an adjustment hole and that the adjustment screw 20 may be used to adjust the position of the brackets 5 so that one or more—preferably all—the brackets 5 may be adjusted before the cover support profile 4 is mounted.

With reference to FIGS. 9 to 11, there is shown the profile 32 which is provided as mounting member 3 in the wall system according to the invention. This mounting member 3 is advantageous as it is made from fire-proof material, in particular steel, preferably corrosion-resistant steel, galvanised steel or the like. The mounting member 3 is formed with a central insulation engagement portion 34 and two side surfaces 37 on each side of the central portion 34. The side surfaces 37 are formed in a plane parallel with the central insulation abutting portion 34 and as shown in FIG. 10 connecting portions 36 are formed which are formed as a bend in the sheet material with respect to the central portion 34, which provides extra stiffness to the profile 32. On the outside of the side surfaces 37 there are provided outer portions 38, which are substantially perpendicular to the side surfaces 37. The particular cross-sectional shape of the profile 32, as shown in FIG. 10, provides the profile with a stiffness that ensures an even distribution of the friction forces when the profile 32 is mounted in the wall system sandwiching the insulation material 2 between the profile 32 and the wall 1. The profile 32 is formed with a specific shape providing sufficient stiffness so that the profile 32 does substantially not bend along its longitudinal axis when fitted by pre-stressed fasteners 7. In the central portion 34 of the profile 32 there is provided mounting holes 35 and friction enhancing knobs such as an array of rearwardly extending embossings 33 comprising openings 31.

The invention claimed is:

1. A substructure for aligning a building cover structure for an insulated wall comprising: a layer of insulation material, which is mounted to the wall by a plurality of elongated insulation mounting members in the form of insulation retaining profiles which are secured to the wall by fasteners, and where a building cover means is mountable to the mounting members via an adjustment means for adjusting the distance between the mounting members and the building cover means, wherein the adjustment means comprises a plurality of assembly brackets, and each assembly bracket comprises a building cover receiving first end and two distal second ends which extend into the insulation material but do not fully penetrate the insulation material, and wherein each bracket is provided with apertures between said first and second ends for receiving associated fasteners for securing the assembly bracket to the building cover means and to the insulation mounting members.

2. A substructure according to claim 1, wherein the building cover means comprises cover support profiles, which are mounted on the mounting members with the assembly brackets between the mounting members and the cover support profiles.

3. A substructure according to claim 2, wherein each of the assembly brackets comprises the building cover receiving first end, which is adapted for receiving the building cover support profile, and the distal second end, which is adapted for penetration into the insulation material on one or both sides of the insulation mounting member.

4. A substructure according to claim 1, wherein the assembly brackets are made of a sheet material.

5. A substructure according to claim 1, wherein the assembly brackets are mounted on each side of the cover support profile.

6. A substructure according to claim 1, wherein each assembly bracket is provided with at least two generally horizontally oriented rows of mounting holes and/or at least one elongated holes.

7. A substructure according to claim 6, wherein the assembly apertures include a first row of discrete holes and at least one elongated hole substantially parallel to the first row of holes.

8. A substructure according to claim 7, wherein the row of holes is provided above the at least one elongated hole on the assembly bracket(s) on a first side of the cover support profile and the at least one elongated hole is provided above the row of holes on the other side of the cover support profile.

9. A substructure according to claim 6, wherein the assembly bracket is provided with three rows of mounting holes and that the middle row is made up by one or more elongated holes.

10. A substructure according to claim 1, wherein the assembly brackets are U-shaped having a central portion accommodating the cover support profile at the first end and two profile portions having distal ends adapted for penetrating the insulation on each side of the mounting member when mounted thereon.

11. A substructure according to claim 1, wherein the distal end is provided with a cutting edge for facilitating penetration into the insulation material.

12. A substructure according to claim 1, wherein the insulation material is a mineral fibre insulation material with a density of 75-180 kg/m$^3$.

13. A substructure according to claim 1, wherein the substructure is capable of carrying a building cover structure ranging from 0-90 kg/m$^2$.

14. A substructure according to claim 1, wherein the elongated insulation mounting members are steel profiles with a substantially vertical orientation.

15. A substructure according to claim 2, wherein the cover support profiles are oriented substantially parallel with the mounting members.

16. A substructure according claim 2, wherein the cover support profiles are oriented substantially perpendicular to the mounting members.

17. A substructure according to claim 2, wherein the cover support profile is provided with at least one adjustment screw provided through a hole in said profile and in threaded engagement with an opening in the underlying mounting member.

18. A substructure according to claim 17, wherein the mounting member is a steel profile, which is provided with a friction enhancing surface comprising an array of embossings for abutting the insulation material, where the embossings include a plurality of adjustment screw receiving openings.

19. A substructure according to claim 17, wherein the hole for receiving adjustment screw is provided with a bowl-like shape for accommodating the head of the adjustment screw in a countersunk configuration.

20. A substructure according to claim 17, wherein the adjustment screw may be provided with a retention means, for snap-engagement with the cover support profile.

21. An assembly bracket for adjustment of a substructure of an insulated wall comprising a layer of insulation material which is mounted to the wall by a plurality of elongated insulation mounting members in the form of insulation retaining profiles which are secured to the wall by fasteners, and where a building cover means is mountable on the mounting members via said assembly bracket, wherein the assembly bracket comprises a building cover receiving first end and two distal second ends which extend into the insulation material but do not fully penetrate the insulation material, and wherein the bracket is provided with apertures between said first and second ends for receiving associated fasteners for securing the assembly bracket to the building cover means and to the insulation mounting members.

22. A bracket according to claim 21, wherein the assembly bracket is made of a sheet material.

23. A bracket according to claim 21, wherein the assembly bracket is provided with at least two generally horizontally oriented rows of mounting holes and at least one elongated hole.

24. A bracket according to claim 23, wherein the assembly apertures include a first row of discrete holes and at least one elongated hole substantially parallel to the first row of holes.

25. A bracket according to claim 24, wherein the row of holes is provided above the at least one elongated hole on the assembly bracket on a first side of the cover support profile and the at least one elongated hole is provided above the row of holes on the other side of the cover support profile.

26. A bracket according to claim 23, wherein the assembly bracket is provided with three rows of mounting holes and that the middle row is made up by one or more elongated holes.

27. A bracket according to claim 21, wherein the assembly bracket is U-shaped having a central portion accommodating the cover support profile at the first end and two profile portions having distal ends adapted for penetrating the insulation on each side of the mounting member when mounted thereon.

28. A bracket according to claim 21, wherein the distal end is provided with a cutting edge for facilitating penetration into the insulation material.

* * * * *